US011913243B1

(12) United States Patent
Schlangen

(10) Patent No.: US 11,913,243 B1
(45) Date of Patent: Feb. 27, 2024

(54) CLIMBING SYSTEMS, KITS, ASSEMBLIES, COMPONENTS, AND METHODS FOR REDUCING CONSTRUCTION ACCIDENTS

(71) Applicant: James M. Schlangen, Monticello, MN (US)

(72) Inventor: James M. Schlangen, Monticello, MN (US)

( * ) Notice: Subject to any disclaimer, the term of this patent is extended or adjusted under 35 U.S.C. 154(b) by 0 days.

(21) Appl. No.: 17/979,562

(22) Filed: Nov. 2, 2022

Related U.S. Application Data

(63) Continuation-in-part of application No. 17/379,914, filed on Jul. 19, 2021, now abandoned.

(60) Provisional application No. 63/053,671, filed on Jul. 19, 2020.

(51) Int. Cl.
*E04G 5/00* (2006.01)
*E04G 5/14* (2006.01)

(52) U.S. Cl.
CPC ..... *E04G 5/001* (2013.01); *E04G 5/142* (2013.01)

(58) Field of Classification Search
CPC ..... E04G 5/001; E04G 5/14; E04G 5/142; E04G 1/34; E04G 1/381; E04G 7/08; E04G 25/06; E04B 2/821; E04B 2/824; E04B 2/825; E04B 2002/749; E04B 2002/7492; E06C 1/12; E06C 1/125
USPC ..... 182/112, 93
See application file for complete search history.

(56) References Cited

U.S. PATENT DOCUMENTS 238,067 A * 2/1881 Teed ..... E06C 1/381 182/189
388,829 A * 9/1888 Clark ..... E06C 1/34 182/83
407,322 A * 7/1889 Barker ..... E06C 1/381 182/83

(Continued)

FOREIGN PATENT DOCUMENTS

CN 108952552 A * 12/2018 ..... E06C 1/381

OTHER PUBLICATIONS

Industrial Safety Products, Miller GlideLoc 40' Ladder Climbing System Kits (Rail), https://www.industrialsafetyproducts.com/miller-glideloc-40-ladder-climbing-system-kits-rail/#product_description. Nov. 2019.

(Continued)

*Primary Examiner* — Daniel P Cahn
*Assistant Examiner* — Shiref M Mekhaeil
(74) *Attorney, Agent, or Firm* — Eduardo E. Drake; Fantastic IP Consulting

(57) ABSTRACT

To address one or more of these and/or other needs or problems with the use of climbing aids in the construction industry, the present inventor devised, among other things, one or more exemplary systems, kits, methods, devices, assemblies, and/or components related to providing safe and efficient means for installing temporary walls in commercial building projects as well as for other situations where conventional ladders pose heightened risk of injury and death. One exemplary system includes a telescopic climbing mast having a minimal operational length in the range of at least 15 feet, extending between a base support and a ceiling interface configured to resist lateral movement of an upper end of the mast. An upper portion of the mast further (Continued)

includes a worker safety line tie-off point for connection to a retractable fall restraint line.

4 Claims, 5 Drawing Sheets

(56) References Cited

U.S. PATENT DOCUMENTS 591,603 A * 10/1897 Henning et al. ..... E06C 1/381 182/63.1
799,360 A * 9/1905 Smith ..... E06C 1/381 182/189
928,478 A * 7/1909 Smalley et al. ..... E06C 9/04 182/189
950,182 A * 2/1910 Mercer ..... E06C 1/381 182/189
2,038,115 A * 4/1936 Keller ..... E04B 2/825 52/241
2,084,303 A * 6/1937 Applegarth ..... E06C 9/08 182/106
2,101,053 A * 12/1937 Della Santina ..... E06C 9/08 182/106
2,148,099 A * 2/1939 Bray ..... E06C 1/381 182/189
2,204,671 A * 6/1940 Erickson ..... E04H 12/182 182/127
2,362,170 A * 11/1944 Swaisgood ..... E06C 5/06 14/72.5
2,438,173 A * 3/1948 Johnson ..... E04G 1/34 182/180.1
2,744,674 A * 5/1956 Smith ..... E06C 7/48 182/189
2,785,842 A * 3/1957 Phelps ..... E06C 9/04 52/707
2,881,813 A * 4/1959 Lacoste ..... E04F 21/0015 269/296
3,026,962 A * 3/1962 Kramer ..... E06C 7/48 182/189
3,083,795 A * 4/1963 Land ..... E04B 2/821 248/354.3
3,084,759 A * 4/1963 Squire ..... E04G 21/3233 256/65.14
3,168,163 A * 2/1965 Prosser ..... E04G 1/36 182/128
3,169,603 A * 2/1965 Amic, Sr. ..... E04F 11/068 182/78
3,366,361 A * 1/1968 Gostling ..... E04G 25/06 254/98
3,589,682 A * 6/1971 Dickey ..... E04G 21/3233 256/65.1
3,598,200 A * 8/1971 Thompson ..... E06C 7/186 182/8
3,703,269 A * 11/1972 Meriz ..... E04G 25/08 248/354.1
3,847,340 A * 11/1974 Ficken ..... E04G 11/10 249/188
4,125,174 A * 11/1978 Lienhard ..... E04G 1/36 182/229
4,132,288 A * 1/1979 Bingham ..... E06C 1/381 182/189
4,252,214 A * 2/1981 Miller ..... E06C 7/186 182/8
4,339,219 A * 7/1982 Lay ..... E04F 21/1822 414/11
4,413,706 A * 11/1983 Michael ..... A63B 27/00 248/216.1
4,452,337 A 6/1984 Atzinger
4,454,690 A * 6/1984 Dixon ..... E04B 2/824 52/126.3
4,729,453 A * 3/1988 Lyons, Sr. ..... E06C 9/06 182/100
4,949,808 A * 8/1990 Garnett ..... E06C 5/38 182/63.1
4,955,592 A * 9/1990 Brennan, Sr. ..... E04G 21/167 269/68
4,981,195 A * 1/1991 Merrick ..... E04F 11/0201 182/189
5,033,584 A * 7/1991 Battle ..... E06C 1/22 182/208
5,109,954 A * 5/1992 Skyba ..... E06C 1/10 182/189
5,125,476 A * 6/1992 Merrick ..... E06C 1/38 182/189
5,255,489 A * 10/1993 Matsumoto ..... E04G 21/167 52/749.1
5,310,153 A * 5/1994 Jackson ..... E04G 25/065 248/161
5,413,191 A * 5/1995 Kerr ..... E06C 9/12 182/39
5,655,623 A * 8/1997 Skyba ..... E06C 1/381 182/100
5,692,357 A * 12/1997 McCain ..... E04F 21/0076 33/528
5,908,082 A * 6/1999 Turner ..... A62B 1/20 182/18
5,913,788 A * 6/1999 Herren ..... E04B 2/825 52/236.7
D420,147 S 2/2000 Woller, Sr.
6,155,022 A * 12/2000 DeCanio ..... A63C 19/08 52/766
6,176,063 B1 * 1/2001 Warin ..... E04F 21/1811 52/749.1
6,315,077 B1 * 11/2001 Peacock ..... E04G 15/061 182/92
6,619,427 B1 * 9/2003 Kerr ..... A47B 96/00 182/39
6,666,456 B1 * 12/2003 Swankie ..... E06C 1/34 182/189
6,668,975 B2 * 12/2003 Skipper ..... E06C 7/006 182/189
6,913,349 B2 7/2005 Hirota
7,219,766 B2 * 5/2007 Deuer ..... E06C 7/186 182/206
7,748,195 B2 * 7/2010 Keith ..... E04G 5/04 182/87
7,967,110 B2 * 6/2011 Parker ..... E04F 11/068 182/195
8,113,479 B1 * 2/2012 O'Connell ..... A62B 3/00 248/351
8,261,880 B1 * 9/2012 Hop ..... E06C 7/182 182/100
8,490,335 B2 * 7/2013 LaForest ..... A47C 1/126 52/8
8,646,223 B2 * 2/2014 Brewka ..... E04G 13/06 52/107
8,733,502 B2 * 5/2014 Larson ..... E06C 1/397 182/39
8,875,774 B1 * 11/2014 Flores ..... E04G 21/247 52/749.1
9,249,568 B2 * 2/2016 Hoefler ..... E04B 2/7433
9,863,187 B2 * 1/2018 Parker ..... E04F 11/068
10,041,249 B1 * 8/2018 Hebert ..... E04G 21/243
10,267,122 B2 * 4/2019 Toma ..... E21B 41/00
10,391,011 B2 * 8/2019 Miller ..... F16M 13/027
10,400,449 B2 * 9/2019 Ollila ..... B65G 53/26
10,415,313 B2 * 9/2019 Barendregt ..... E06C 9/02
10,890,029 B2 * 1/2021 Simon ..... E06C 7/46
11,613,928 B1 * 3/2023 Davidson ..... E06C 7/50 182/178.3
2002/0157335 A1 * 10/2002 Vos ..... E04B 2/821 52/239
2003/0146048 A1 * 8/2003 Garbs ..... E06C 1/381 182/100
2004/0200669 A1 * 10/2004 Saccente ..... E06C 1/12 182/204
2005/0161571 A1 * 7/2005 Wood ..... E04G 25/06 248/354.3

(56) References Cited

U.S. PATENT DOCUMENTS

| | | | | |
|---|---|---|---|---|
| 2005/0284703 | A1* | 12/2005 | Deuer | E06C 7/186<br>182/206 |
| 2006/0169536 | A1* | 8/2006 | Davis | E06C 5/04<br>182/127 |
| 2007/0246299 | A1* | 10/2007 | Wright | E04G 21/3242<br>182/113 |
| 2007/0256892 | A1* | 11/2007 | Breedlove, Sr. | E06C 1/34<br>182/116 |
| 2008/0209827 | A1* | 9/2008 | Webb | E04B 2/821<br>52/220.7 |
| 2009/0301812 | A1* | 12/2009 | Kerr | E06C 1/397<br>182/39 |
| 2012/0193167 | A1* | 8/2012 | Winter, IV | E06C 7/505<br>182/78 |
| 2015/0075907 | A1* | 3/2015 | Moss | E06C 7/48<br>182/129 |
| 2015/0226002 | A1 | 8/2015 | Johansen | |
| 2015/0297921 | A1* | 10/2015 | Putzer | E04G 3/00<br>182/222 |
| 2016/0016599 | A1* | 1/2016 | Harber | E06C 1/125<br>280/651 |
| 2020/0080377 | A1* | 3/2020 | Simon | E06C 7/423 |
| 2022/0088425 | A1* | 3/2022 | Miller | A62B 35/04 |

OTHER PUBLICATIONS

Scaffold Service Inc., Basic Scaffold/Swing Guide & Catalog, Jan. 2013.

* cited by examiner

CLIMBING SYSTEMS, KITS, ASSEMBLIES, COMPONENTS, AND METHODS FOR REDUCING CONSTRUCTION ACCIDENTS

RELATED APPLICATIONS

The present application claims priority to U.S. Non-Provisional patent application Ser. No. 17/379,914, filed Jul. 19, 2021, which claims priority to U.S. Provisional Patent Application 63/053,671 filed Jul. 19, 2020. Both of these applications are incorporated herein by reference in their entirety.

COPYRIGHT NOTICE AND PERMISSION

A portion of this patent document contains material subject to copyright protection. The copyright owner has no objection to the facsimile reproduction by anyone of the patent document or the patent disclosure, as it appears in the patent and trademark office patent files or records, but otherwise reserves all copyrights whatsoever. The following notice applies to this document: Copyright© 2020, JAMES M. SCHLANGEN.

TECHNICAL FIELD

Various embodiments of the invention relate to climbing equipment and construction methods, particularly equipment and methods that provide fall protection to workers in situations where such protection is inconvenient or costly to use.

BACKGROUND

Each year, there are more than 164,000 emergency room-treated injuries and 300 deaths in the U.S. that are caused by falls from ladders. Falls from ladders are the leading cause of deaths on construction sites.

On construction sites, one problem recognized by the current inventor concerns the use of ladders in building temporary floor-to-ceiling walls or barriers. These walls are typically built-in commercial facilities, such as hospitals, to separate construction areas from non-construction areas, and thus protect construction workers from hospital borne pathogens and hospital staff and patients from construction traffic, noise, and dust. Sometimes temporary walls are also used to provide temporary office space. The temporary floor-to-ceiling walls are generally 18 feet high, and hospital operating constraints confine construction to a two-feet wide strip of preexisting hallways. The space is too narrow for conventional scaffolding, nudging time-pressured workers to use extension ladders at nearly vertical angles with a great risk of tipping. Unfortunately, this desire for efficiency and the lack of convenient solutions leads many workers to use the ladders without tipping guards or fall protection, risking serious injury and even death.

Accordingly, the present inventor has recognized a need for ways of using ladders in building not only temporary walls, but also other tall structures, without compromising worker safety.

SUMMARY

To address one or more of these and/or other needs or problems, the present inventor devised, among other things, one or more exemplary systems, kits, methods, devices, assemblies, and/or components related to providing safe and efficient means for installing temporary and permanent walls in commercial building projects as well as for other situations where conventional ladders pose heightened risk to injury to workers.

Some exemplary embodiments provide a climbable safety assembly having an upper ceiling interface portion to resist lateral movement, a compression force generator, an adjustable length mast structure extending therebetween, and an OSHA-compliant fall-restraint tie-off point. The mast structure, for example a telescopic arrangement of two or more nested steel tubes of circular, square or rectangular cross-section, reaches 15-20 or more feet in height when fully extended in a vertical or near vertical (approximately 70-90 degree) angle relative to a horizontal floor or other base support surface. The upper ceiling interface portion can take the form of a top plate having first and second opposing surfaces, with the first surface configured to engage the underside of a ceiling structure, such as a fluted concrete or metal structural deck, and the second surface configured to engage the upper most end of the mast structure. Mounted to the upper end of the mast structure is the OSHA-compliant tie-off point, which is configured for connection to a worker fall restraint, such as a safety harness. The compression force generator, for example hydraulic, screw, rachet jack, or winch mechanism, has a base portion configured to rest on a support surface and generate sufficient compression through the linkage of the mast structure and the ceiling interface portion with the ceiling to prevent or resist lateral movement of the upper end of the mast, and thus not only reduce or eliminate the risk of the structure tipping, but also provide sufficient support to restrain a falling worker.

In some embodiments, the base portion has a two-dimensional base or floor contact area with at least one of the two dimensions, being no more than two feet (24 inches) or another amount to satisfy the hospital or other construction passageway constraints. Also in some embodiments, the ceiling interface includes a vertical pin projection configured for insertion into a bore hole in the surface of the ceiling structure. The walls of the bore hole limit lateral movement of the vertical pin projection and thus the top of the mast structure to the cross-sectional area of the bore hole, providing increased tipping protection. In other embodiments, the ceiling interface includes an adhesive, magnetic, or hook-and-loop type high-friction engagement between the top of the mast structure and the ceiling. In still other embodiments, the ceiling interface includes an inflatable air bag with a center hole or recess configured to fit around or over the top of the mast structure and to filled with pressurized air via a pump to fill in space between the top of the mast and two adjacent joists, restricting movement of the upper end of the mast.

In some embodiments, two similarly installed mast assemblies can support the opposing ends of one or more walking planks to provide a horizontal work surface in lengths, such as 8, 10, or 12 feet for example, all within a narrow width of two feet or less.

BRIEF DESCRIPTION OF DRAWINGS

Various embodiments are described herein with reference to the following attached figures (Figs). These figures are annotated with reference numbers for various features and components, and these numbers are used in the following description as a teaching aid, with like numbers referring to the same or similar features and components.

DETAILED DESCRIPTION OF THE EXEMPLARY EMBODIMENT(S)

This document, which incorporates drawings and claims, describes one or more specific embodiments of one or more inventions. These embodiments, offered not to limit but only to exemplify and teach the invention, are shown and described in sufficient detail to enable those skilled in the art to implement or practice the invention(s). Thus, where appropriate to avoid obscuring the invention(s), the description may omit certain information known to those of skill in the art.

Figure 1:
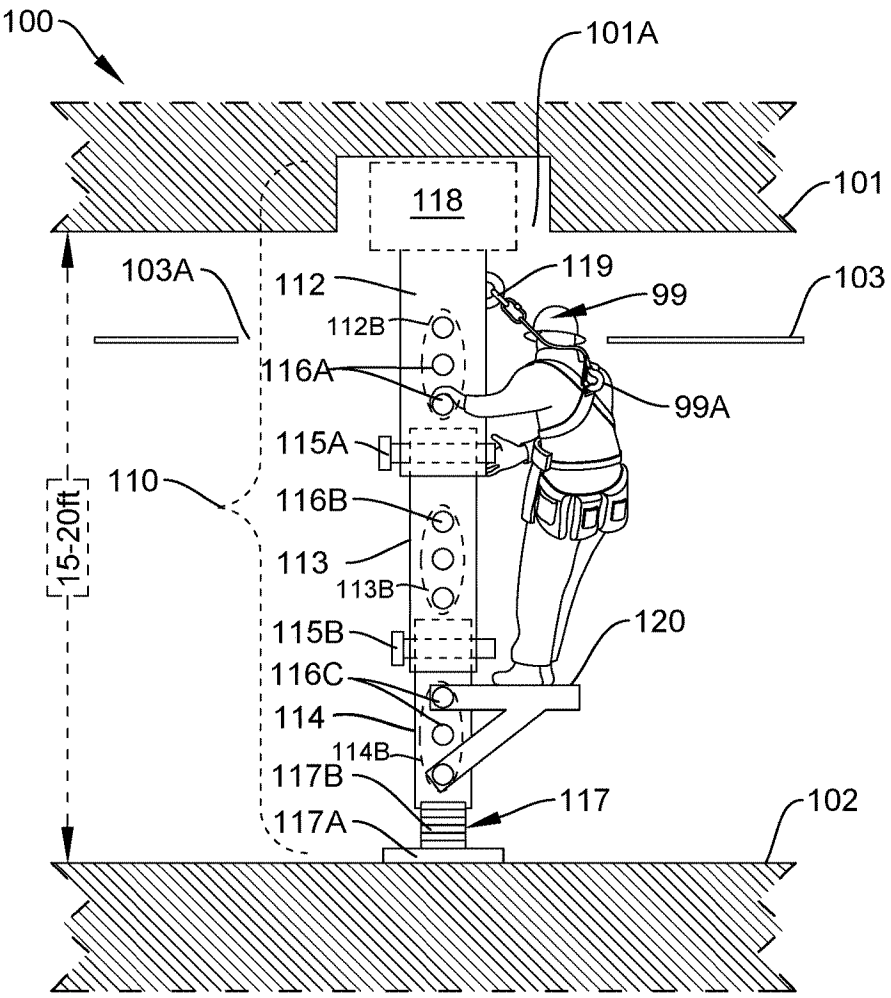
FIG. 1 is a profile view of an exemplary climbing and scaffolding system 100, corresponding to one or more embodiments of the present invention.

FIG. 1 shows a worker 99 equipped with a self-retracting fall restraint harness assembly 99A, using an exemplary vertical or near-vertical climbing mast and scaffolding system 100. System 100 is shown erected between generally horizontal support surfaces 101 and 102, which are separated via an intermediate ceiling level 103 having an opening 103A. (As used herein, vertical or near-vertical means that the mast form an angle in the range of 70-90 degrees, inclusive, with at least one and preferably both support surfaces for the system.) In some embodiments, support surfaces 101 and 102 take the form of upper and lower concrete, wood, or steel structural decks in a hospital or other commercial building, with the decks or surfaces being separated by 15-20 feet, for example 18 feet, with surface 101 including one or more flutes or channels, such as representative channel 101A. In some embodiments, adjacent joists or beams—more precisely the opposing sidewalls thereof—define the channels. In some embodiments, the support surfaces 101 and 102 may be spaced further or closer together. System 100 includes tie-off climbing mast assembly 110, with a work platform assembly 120.

Tie-off climbing mast assembly 110, which extends through opening 103A and contacts supporting surfaces 101 and 102, includes three nested and telescopically extendable and collapsible sections 112, 113, and 114; retention pins 115A and 115B; climbing support rungs 116, a lifter 117; an anti-tip assembly 118, and a safety tie-off structure 119.

Sections 112, 113, and 114, which in some embodiments take the form of eight-foot-long cylindrical or rectangular steel tubing, are nested in a coaxial telescoping arrangement. In other words, the sections are configured such that top section 112 has inner dimension large enough to encompass the outer dimensions of middle section 113, and middle section 113 has inner cross-sectional dimensions large enough to encompass the outer cross-sectional dimensions of lower section 114. Exemplary nominal outer cross-sectional dimensions for respective sections 112, 113, and 114 are 4"×4", 3.5"×3.5", 3"×3", thus defining an inverted pyramidal structure with sections 112, 113, and 114 stacked in ascending order of outer cross-sectional dimensions, that is from smallest to largest as one moves upward from surface 102 to surface 101. (In some embodiments, the sections take the form of 8-foot long, 0.25- or 0.375 inch-thick square or cylindrical steel or aluminum tubes or nested rectangular or semicircular C-channels; other embodiments use nested steel or aluminum angle.) Sections 112, 113, and 114 include respective sets of retention pin through holes distributed along their lengths, with respective retentions pins 115A and 115B extending through two of them to lock or retain each pair of adjacent sections in a desired extended co-axial relationship with each other, thereby setting the length of the mast assembly in its axial dimension. In the exemplary embodiment, the length of the assembly including all three sections is variable between 15-20 feet, inclusive. For example, in some applications, such as hospital renovations, the length of the mast formed by the three sections is set to 18 feet.

In addition to retention-pin through holes 112A, 113A, and 114A, sections 112, 113, and 114 include respective sets 112B, 113B, and 114B of climbing-rung through holes for climbing support rungs, of which support rungs 116A, 116B, and 116C are representative. The climbing-rung through holes are transverse, for example, perpendicular, to the retention-pin holes. In some embodiments, the diameter of the retention pin holes is smaller than that of the climbing-rung holes, for example 0.75 inches compared to 0.875 inches, to prevent usage of the retention pins as climbing rungs. Base section 114, more precisely lower portion 114L thereof, is attached to lifter 117 which rests on support surface 102.

Lifter 117, which takes the form of a hydraulic, screw, pump, or rachet jack, includes a base plate portion 117A and an actuator 117B. The base plate portion has a footprint with a maximal extent in at least one dimension that is at most two feet to satisfy dimensional constraints of the worksite, for example a hallway width constraint. In some embodiments, the baseplate portion includes one or more leveling mechanisms, such as leveling feet (not shown), to facilitate vertical alignment of the mast assembly with surface 102. Actuator 117B, which may be manual or motorized, operates the lifter to exert an axial lift or compression force on the mast structure that is ultimately communicated or transferred through sections 112, 113, and 114 to anti-tip assembly 118, which interfaces with upper support surface 101. In some embodiments, the lifter includes a weigh scale, pressure plate, or axial strain gauge to indicate when sufficient compression forces has been established between the mast assembly and surfaces 101 and 102 to meet OSHA or other fall arrest parameters.

Anti-tip assembly 118, which may take a variety of forms detailed below, is configured to resistant lateral movement of the upper end of section 112 relative to surface 101 as worker 99 engages with the mast and work platform 120.

In the event of a fall and full engagement of worker 99 with safety tie-off structure 119 via safety line 99B, anti-tip assembly 116, or more precisely its engagement with surface 101, resists or inhibits lateral movement of the upper end of the mast assembly, allowing the mast assembly in combination with the fall restraint harness to restrain or arrest a falling worker in accord with or in excess with OSHA safety standards.

Figure 2D:
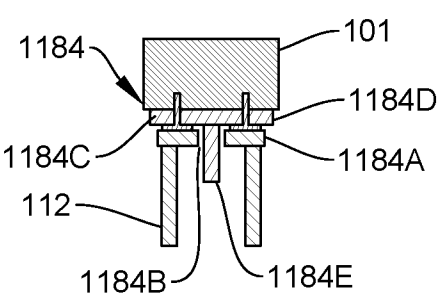
FIGS. 2A, 2B, 2C, 2D, 2E, 2F, 2G, and 2H are schematic cross-sectional views of alternative anti-tip assembly portions of system 100, corresponding to one or more embodiments of the present invention.
Figure 2C:
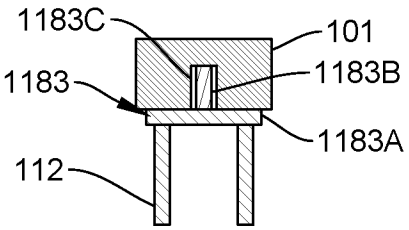

FIGS. 2A-2H show exemplary forms for anti-tip assembly 118, respectively denoted as 1181, 1182, 1183, 1184,

1185, 1187, 1187, and 1188. Specifically, FIG. 2A shows that assembly 1181 includes with a horizontal plate 1181A which abuts surface 101 in an interference or compression fit. Plate 1181A, in some embodiments is formed of a a metal, such as steel or aluminum, welded or otherwise fastened to the top port of section 112. In some embodiment, plate 1181A includes a compressible or deformable materials such as a rubber, silicone, or a thermoplastic to established higher slide friction with surface 101 when pressures from lifter 117.

Figure 2B:
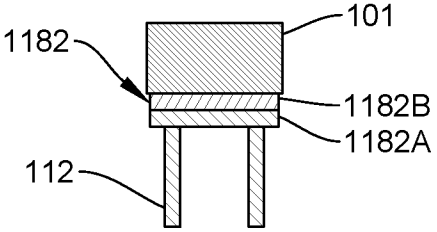
Figure 2A:
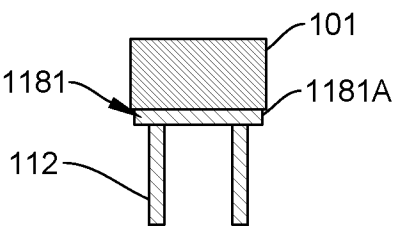

FIG. 2B shows that assembly 1182 includes a horizontal plate 1182A, similar to plate 1181A, as well as an adhesive joint layer 1182B, which permanently or temporarily bonds plate 1182A to surface 101. In some embodiments the adhesive is a double-sided 3M Command adhesive strips or patches, or 3M™ GPH series of VHB™ tape, available from 3M of St. Paul, Minnesota. Some embodiments use pressure-sensitive adhesives which use sufficiently high pressure from lifter 117 provide an enhanced slide friction between the plate and surface 101, resisting lateral movement of the plate and upper end of section 112 and thus the mast assembly relative to surface 101. Some embodiments provide electrically, thermally, or chemically releasable adhesive in combination with suitable remotely actuatable release mechanisms, such wired or wireless control circuitry including a battery, a voltage regulator, and a remotely operable switch to apply appropriate control voltages to electrically, or in some embodiments thermically or chemically release the adhesive bond. Exemplary releasable adhesives include ElectRelease-E3 epoxy available from EIC Laboratories of Norwood, Massachusetts.

FIGS. 2C and 2D show respective anti-tip assemblies 1183 and 1184, both of which incorporate a male-female type coupling between the mast assembly and surface 101. In particular, assembly 1183 includes a horizontal plate 1183A, which, like plates 1181A and 1182A, is mounted to the upper end of section 112. Further, a vertical pin 1183B extends upward from horizontal plate 1183A, into a bore hole 1183C in support surface 101, with walls of the bore hole resisting or limiting lateral movement of the upper end of the mast assembly. In contrast, assembly 1184 provides a horizontal plate 1184A having a bore hole 1184B, and a pin plate assembly 1184C mounted to surface 101. The pin plate assembly, which includes a plate 1184D and a vertical pin 1184E extending therefrom, can be bolted or adhered to surface 101.

Figure 2H:
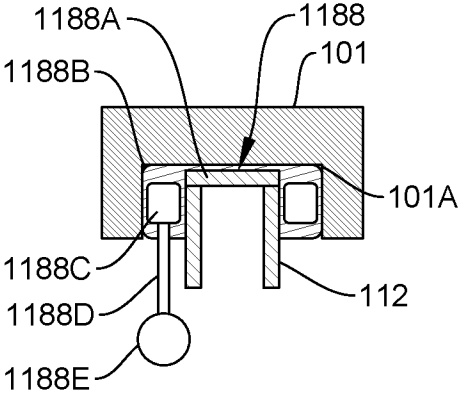
Figure 2G:
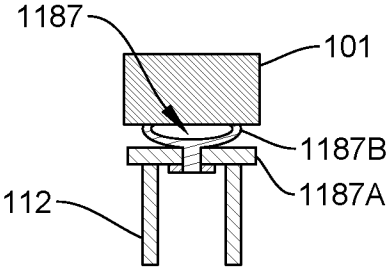
Figure 2F:
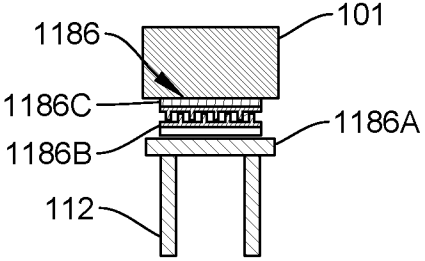
Figure 2E:
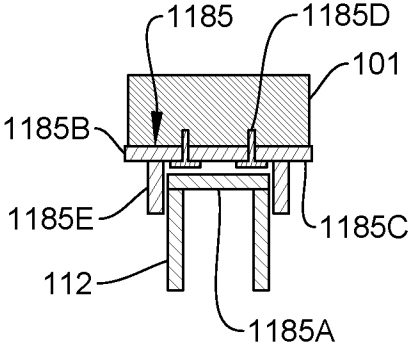

In FIG. 2E, anti-tip assembly 1185 includes horizontal plate 1185A atop section 112, and a retaining collar or frame assembly 1185B. Assembly 1185B includes a top plate 1185C attached to surface 101, via one or more fasteners, such as fastener 1185D, and a retaining ring, collar, or flange 1185E downwardly extending from the top plate and encircling the upper end of section 112. The flange can take a variety of forms, for example metal bars or angles configured in a rectangular form similar to the axial cross section of section 112. Also, some embodiments may use an adhesive or other means described herein to attach assembly 1185B to surface 101. In use, some embodiments leave assembly 1185B in place after removing the climbing mast for future use if desired.

FIGS. 2F and 2G depict respective anti-tip assemblies 1186 and 1187, which include respective horizontal plates 1186A and 1187A. Assembly 1186 includes a hook-and-loop fastening arrangement, comprising a first layer 1186C (hook or loop) mounted to plate 1186A and a second opposing layer (loop or hook) mounted to surface 101, with the layers mounted via adhesive or mechanical fasteners respectively to plate 1186A and surface 101. In operation, the hook and loop fasteners are expected to provide sufficient slide frictional forces to resist the lateral forces that a falling worker would transfer through safety harness 99A to mast 110. Assembly 1187 includes an industrial suction cup 1187B with its non-suction (or convex) side attached to plate 1187A, such that its concave or suction side is pressed against surface 101 in response to upward actuation of lifter 117, creating a vacuum pressure and consequent attraction between the upper portion of section 112 and surface 101. In some embodiments, the pressure is released through downward actuation of the lifter. Some embodiments may include a mechanical or electromechanical relief valve and associated control, preferably remote control, to facilitate this release FIG. 2H shows that anti-tip assembly 1188 includes a horizontal plate 1188A atop section 112, a surrounding inflatable air bag 1188B surrounding the top end of section 112, an air hose 1188D connecting interior of circumferential air chamber 1188C of air bag 1186B to pump or air tank 1188E. Air bag 1186B, formed for example of a Kevlar reinforced silicone or rubber, takes a rectangular toroidal or donut shape, sized to engage in an interference or high frictional fit with at least two adjacent sidewalls of channel 101A. In some embodiments, chamber 1188C is filled with a gel or fluid via pump 1188. In some embodiments, the chamber is filled with fluid after establishing desired axial compression force of the mast between surfaces 101 and 102 with lifter 117. In the event of a worker such as worker 99 falling and exerting lateral force on mast section 112, it is expected that some of the force would be absorbed via compression of bag 1188B, reducing impact experienced by the worker from fall arrestment via harness 99A.

FIG. 1 shows that system 100 also includes work platform 120. Work platform includes a vertical hanger portion 121 and a cantilevered platform or shelf 122, with the hanger portion 121 having hook portions 121A and 121B engaged with respective rungs in the mast structure, and shell 122 cantilevered horizontally from the hanger portion and supported via strut 123. The work platform can be extended in length to form a fully traversable scaffold level, as shown in FIG. 3.

Figure 3:
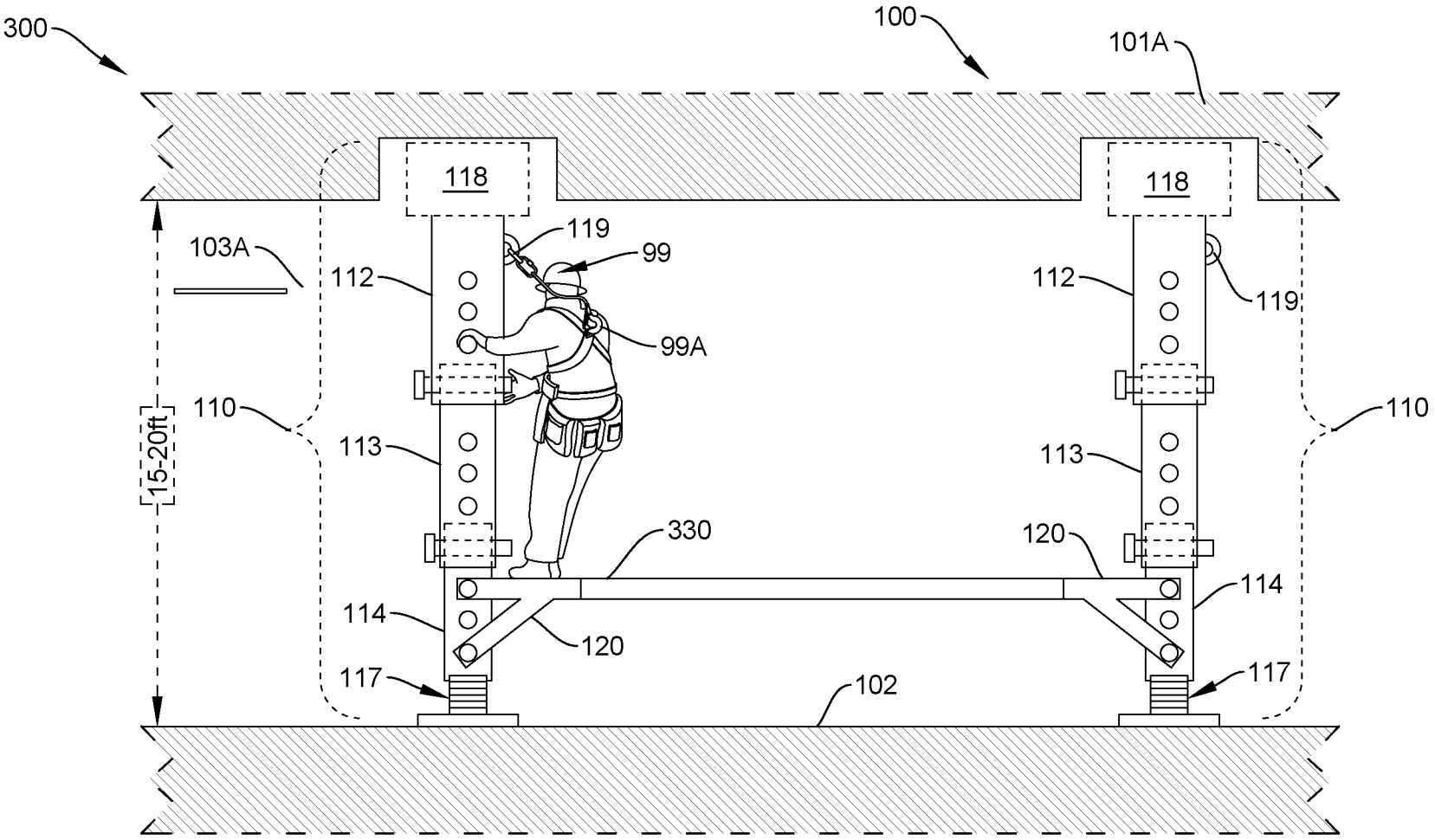
FIG. 3 is a profile view of an alternative climbing and scaffolding system 300, incorporating portions of system 100 and corresponding to one or more embodiments of the present invention.

FIG. 3 shows a scaffolding system 300, including two climbing mast assembly 110A and 110B, erected between surfaces 101 and 102. A work plank assembly 320 extends between the two climbing mast assemblies, supported at opposing ends via respective work platforms 120A and 120B. in some embodiments, work platforms 120A and 120B are attached via winch assemblies to an upper portion their respective masts, facilitating raising and lower of the plank via operation of the winches.

Figure 5:
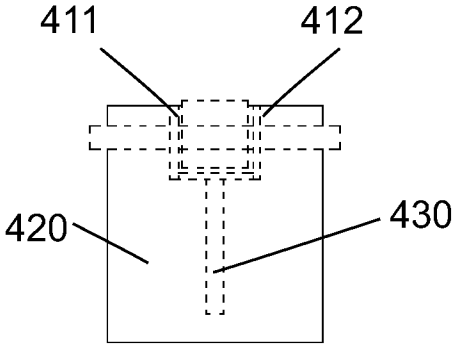
FIGS. 4, 5, and 6 are respective left, top, and front views of an exemplary work platform assembly 400, suitable for use with the FIG. 1 and FIG. 3 systems and corresponding to one or more embodiments of the present invention.
Figure 6:
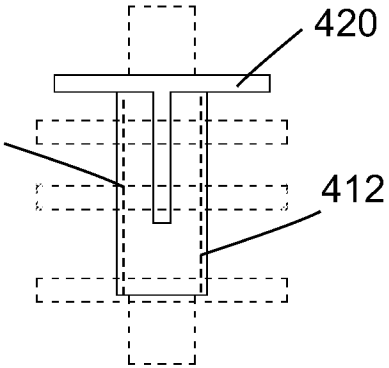
Figure 4:
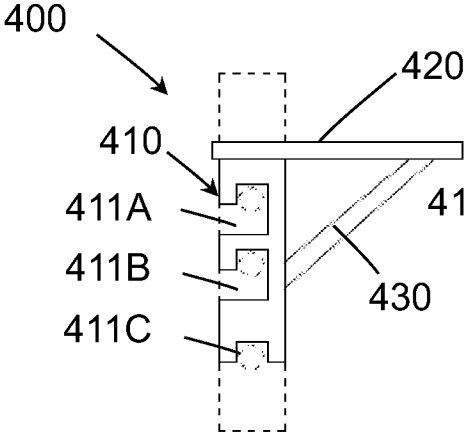

FIGS. 4, 5, and 6 show respective profile, top, and front views of an alternative work platform 400. Notably platform 400 includes a hanger assembly 410 including opposing hanger side rails 411 and 412. Each side rail includes respective sets of gravity locking side slots, with side rail 411 including slots 411A, 411B, 411C. The slots in side rail 412 (not visible in the views shown) are the mirror image of the 411 slots. The slots include an open access end for receiving a climbing rung and a closed locking end which positively locks under weight of the platform with the supporting climbing rung, preventing or limiting lateral movement of the platform relative to the climbing rung and mast structure. In slot 411C, the bottom slot, the open access end and closed access end are one and the same. Platform 400 also includes a horizontal platform portion 420 and a support strut 430, both welded or otherwise fastened to hanger assembly 410.

Exemplary Methods

Figure 7:
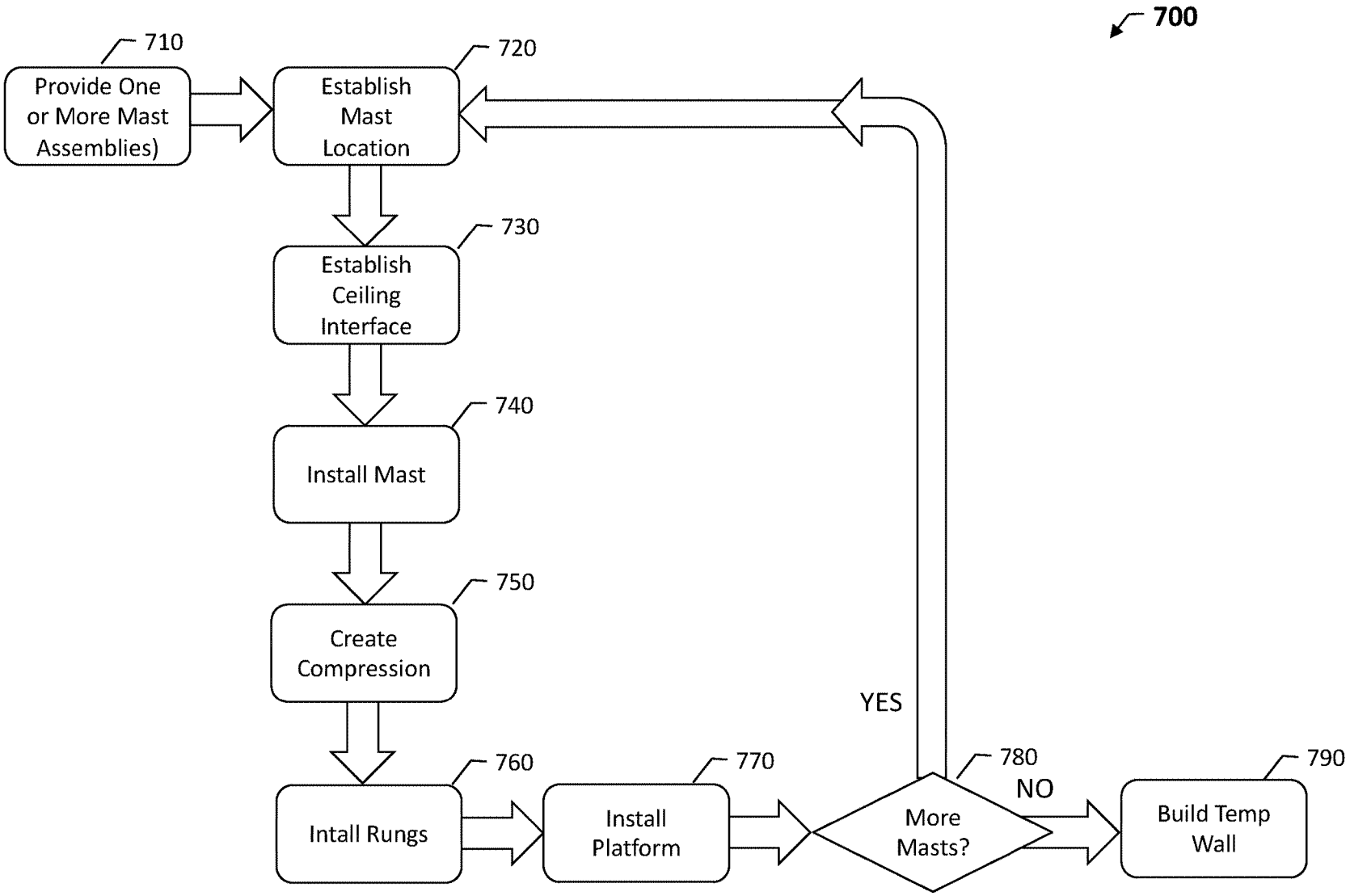
FIG. 7 is a flow chart of an exemplary method of installing systems 100 and 300, corresponding to one or more embodiments of the present invention.

FIG. 7 shows a flow chart 700 of one or more exemplary methods of operating or assembly a climbing mast assembly, such as system 100 or 200, in building or installing virtually any structure requiring high worker access. Exemplary applications include construction of temporary walls (between a construction zone and a non-construction zone), above-ceiling HVAC ducts, electrical conduits, or water pipes in commercial buildings, such as a hospitals or office buildings. Flow chart 700 includes blocks or steps 710-790, which are arranged and described as a sequence in the exemplary embodiment for sake of explanatory clarity and concision. However, some embodiments may change the order of two or more of the blocks or execute two or more of the blocks in parallel.

At block 710, the exemplary method begins with providing one or more mast assembly structures, such as mast assembly 100, in a collapsed or non-extended or unassembled form, in the area where the temporary wall structure is desired. Execution then continues at block 720.

Block 730 entails establishing a proper location, with a clear path from floor to the structural deck above. In some applications, such as building of temporary walls, establishing the proper location includes providing an opening, for example, such as 24"×24" ceiling tile space in the ceiling, to access the structural deck. It is recommended to use a vertical measuring plumb dot laser if available to locate desired position for top of the climbing mast structure. Exemplary execution advances to block 730.

Block 730 entails establishing a ceiling contact or interface point or region for the top of the mast structure. In some embodiments that rely on use of a vertical pin projection to restrict lateral movement of the top of the mast after installation, this entails drilling a bore hole, for example a one-inch diameter, two-inch deep bore hole, into the portion of the structural deck that will interface with the vertical pin projection at the top of the mast structure. Forming the bore hole entails, for example, coupling a hammer drill to an extension pole and using a step ladder to reach the deck with the extended drill. In some embodiments, an additional extension pole is used to eliminate the ladder and associated fall risk.

Some embodiments provide various alternatives to the bore hole. For example, some embodiments install or mount a flat quarter inch-thick plate with a 1" diameter central hole in it, to the underside of fluted deck (preferably over a recessed flute channel) using a set of 1 or more Powder Actuated Fasteners (PAFs). For non-recessed areas of the decking, some embodiments use a thicker plate with a central hole or recess to receive the vertical pin. Mounting of the plate, in some variations, entails holding the plate in desired location with an extension pole and using a PAF gun on an extension pole to secure the plate in the desired location. The plate can also be held up to the desired location with the fully assembled vertical mast structure itself, provided the plate is fastened to the top of the mast, for example using tape, magnets, hook-and-loop fasteners, straps, and/or bungee cords, and then using the PAFs to secure the plate. Notably, some embodiments fasten or secure the interface plate to the structural decking or concrete using suitable adhesives, magnets, suction cups, and/or hook-and-loop fasteners. For these variations, the inventor has recognized that the plate itself need only be secured with sufficient force to resist lateral static and/or dynamic frictional forces that would arise during the falling of a worker tiled to the mast structure, rather than the entire weight of the mast structure and the worker.

Block 740 entails installing or mounting a mast structure to the ceiling interface. In some embodiments, this initially entails assembling the multi-piece mast structure of system 100, horizontally on the floor, bolting or pinning the three sections together to match the desired height, then coupling the ceiling interface fixture and the lifter respectively to its top and bottom ends, and attaching retractable fall protection device to the tie-off attachment point on the top section of the mast structure. In some embodiments, for example some employing the vertical pin into a bore hole or the vertical pin into the mounted ceiling interface plate, the total length of the mast assembly with all members connected is about ½" longer than the plumb distance from the floor (or more generally lifter base plate) to the structural deck interface or contact region. Note that sufficient slack should be pulled out of the retractable fall protection device to hook or tie the safety line to a portion of the mast structure near the bottom of the structure, for example within 4' to 6' from the bottom end of the mast. At this point, the ceiling interface fixture is also prepared for coupling to the ceiling interface area or plate previously established.

Next, the exemplary method entails standing up the assembled mast structure on the lifter base plate, using the clear path chosen originally, inserting the top of the structure through the ceiling access opening and engaging the ceiling interface fixture with the ceiling interface plate or area, while at the same time, bringing the bottom of the post closer to its proper vertical position on the floor. For embodiments using an interface pin or peg, this entails inserting or registering the 2" peg of the top of the mast into or with the ceiling interface hole, from block 730. For embodiments that utilize magnets, adhesive, or hook-loop fasteners, this registration may entail activation of an electromagnet or electro-adhesive, or even in some embodiments, activation of an adhesive curing heating or lighting element.

Block 750 entails applying a compression force through the mast structure to the ceiling interface area. In some embodiments, this entails actuating a lifter, such as lifter 117 in FIG. 1, to lift the mast structure from its base and establish the desired compression. Some embodiments my include suitable compression, pressure, or torque sensors and associated instrumentation to indicate when the desired level of compression is achieved.

Block 760 entails installing the climbing rungs into the mast structure. To this end, the worker dons the safety harness per manufacturer's recommendations, and attaches the retractable lifeline to the safety harness. Thereafter, the worker inserts several steel rods individually through the holes in the post in desired locations or elevations along the length of the mast structure. These rungs, typically spaced like ladder rungs about 10-14 inches apart, extend from the sides of the mast structure 6-8 inches for example.

Block 770 entails installing a work or standing platform onto the one or more mast structures. In some embodiments, this entails hanging first and second pairs of upper and lower hangers of a cantilevered work platform or one end of an extended work plank onto two adjacent pairs of climbing rungs of one of the mast assemblies. See, for example, climbing platform 120 in FIG. 1.

Block 780: If additional climbing masts are desired, blocks 720-790 are repeated for each additional mast. Some embodiments may establish the work platform between two mast structures similar to system 300 in FIG. 3, enabling workers to move between the mast structures at the desired height while tethered via fall protection harness and line to at least one tie off point on one of the mast structures, during construction of the temporary wall, dust or infection barrier. In some embodiment, this extended work platform may have an adjustable height mechanism, using upper mounted hanging platforms and a pulley system attached to the tie off points or to opposing dedicated tie off points.

In some embodiments, the mast structures enable a worker to elevate to a height of 12, 14, or 16 ft or more above the floor, measured from the workers lowest extremity or the height of the standing platform or rung. Also, in some embodiments, the assembly includes the environment of an operating hospital or other commercial building, with the temporary wall positioned to define at least one side of a 5-6' wide hallway. Execution continues at block 790.

Block 790 entails completion of the temporary wall structure. In the exemplary embodiment, this entails use of one or more of the installed climbing masts and work platforms to erect framing, install drywall, barrier films, interlocking sliding panels, and/or other structures for forming a suitable noise, dust, and pathogen barrier structure, for example, suitable for use in renovating an operating hospital.

Other Embodiments

In some embodiments, the nested telescoping members of the climbing mast assemblies include linear or cascaded cable rigging to enable manual or motor actuated extension and retraction of the mast assemblies. See, for example, U.S. Pat. Nos. 4,290,495; 4,837,992; 11,279,048; and 2004/0129417 which are incorporated herein by reference in their entirety for showing exemplary and nonlimiting means for mechanized extension and retraction of telescoping mast members. Also, some embodiments may use a light weight motorized or manually raisable mast to install one or more of the anti-tip assemblies prior to installation of an OSHA compliant mast structure as taught herein.

CONCLUSION

In the foregoing specification, specific exemplary embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms, such as second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed. Also, the term "exemplary" is used as an adjective herein to modify one or more nouns, such as embodiment, system, method, device, and is meant to indicate specifically that the noun is provided as a non-limiting example.

What is claimed is:

1. A climbing assembly configured for extension between an underside of a structural floor decking of a building and a supporting floor of the building, the assembly comprising:

a telescopic climbing structure having an upper end and a lower end defining an axial dimension of the structure, the structure configured for extension between the supporting floor and the structural floor decking, with the lower end configured to contact the supporting floor and the upper end configured to engage with a portion of the structural floor decking, with the structure including at least three nested members, and each of the nested members having a set of two or more climbing-rung through holes and a corresponding set of two or more climbing rungs configured to extend therethrough and thereby fix a corresponding position of each climbing rung along the axial dimension of the climbing structure;

means, including a horizontal late and at least one vertical structure configured to extend into the structural floor decking a predetermined depth, for restricting lateral movement of the upper end of the climbing structure relative to the decking, wherein the means for restricting lateral movement further includes a retaining-collar attached to the horizontal plate, and the one vertical structure includes a pin or a fastener;

means, associated with the climbing structure, for establishing and adjusting a compression force between the upper end of the of the climbing structure and the structural floor decking, wherein the means for establishing and adjusting the compression force includes a jack; and an OSHA-compliant fall-protection tie-off attached to the climbing structure and configured to couple with a worker safety harness.

2. The assembly of claim 1, wherein the nested members are nested such that each member of the nested members that is higher than an other member of the nested members in the climbing structure has a greater outer axial cross-sectional dimension than said other member.

3. The assembly of claim 1, wherein the at least three nested members are nested coaxially.

4. The assembly of claim 1, wherein the telescopic climbing structure includes a set of two or more cantilevered climbing rungs extending therefrom.

* * * * *